US009427796B2

(12) United States Patent
Nakaoka et al.

(10) Patent No.: US 9,427,796 B2
(45) Date of Patent: Aug. 30, 2016

(54) METHOD FOR CONTINUOUSLY CASTING INGOT MADE OF TITANIUM OR TITANIUM ALLOY

(71) Applicant: Kabushiki Kaisha Kobe Seiko Sho (Kobe Steel, Ltd.), Hyogo (JP)

(72) Inventors: Takehiro Nakaoka, Kobe (JP); Eisuke Kurosawa, Kobe (JP); Kazuyuki Tsutsumi, Kobe (JP); Hideto Oyama, Takasago (JP); Hidetaka Kanahashi, Takasago (JP); Hitoshi Ishida, Kobe (JP); Daiki Takahashi, Kobe (JP); Daisuke Matsuwaka, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/439,798

(22) PCT Filed: Jan. 23, 2014

(86) PCT No.: PCT/JP2014/051426

§ 371 (c)(1),
(2) Date: Apr. 30, 2015

(87) PCT Pub. No.: WO2014/115824

PCT Pub. Date: Jul. 31, 2014

(65) Prior Publication Data

US 2015/0298204 A1 Oct. 22, 2015

(30) Foreign Application Priority Data

Jan. 25, 2013 (JP) ..... 2013-012034

(51) Int. Cl.
*B22D 11/16* (2006.01)
*B22D 27/04* (2006.01)
(Continued)

(52) U.S. Cl.
CPC ..... *B22D 11/001* (2013.01); *B22D 11/041* (2013.01); *B22D 11/103* (2013.01);
(Continued)

(58) Field of Classification Search
CPC ... B22D 11/001; B22D 11/041; B22D 11/16; B22D 21/005
USPC ..... 164/151.4, 452, 469, 470, 494, 495, 164/508
See application file for complete search history.

(56) References Cited

U.S. PATENT DOCUMENTS 3,358,743 A * 12/1967 Adams ..... B22D 11/16 164/413
5,273,101 A 12/1993 Lillquist et al.
6,868,896 B2 * 3/2005 Jackson ..... B22D 11/001 164/514

FOREIGN PATENT DOCUMENTS

CN 1067398 A 12/1992
JP H05-192746 A 8/1993
JP 3077387 B2 8/2000

OTHER PUBLICATIONS

Malley et al., "Control of plasma hearth melted ingot surfaces", Proceedings of the tenth International Conference on Vacuum Metallurgy, Metallurgical Industry Press, 1991, pp. 178-188.*
(Continued)

*Primary Examiner* — Kevin E Yoon
(74) *Attorney, Agent, or Firm* — Studebaker & Brackett PC

(57) ABSTRACT

Disclosed is a continuous casting method in which a melt obtained by melting titanium or a titanium alloy is poured into a bottomless mold and is drawn downward while being solidified, wherein: the surface of the melt in the mold is heated by horizontally moving a plasma torch over the surface of the melt; thermocouples are provided at a plurality of locations along the circumferential direction of the mold; if the temperature of the mold measured by one of the thermocouples is lower than a target temperature, then the output of the plasma torch is increased when the plasma torch comes close to the location where that thermocouple is installed; and if said temperature is higher than the target temperature, then the output of the plasma torch is decreased when the plasma torch comes close to the location where that thermocouple is installed.

3 Claims, 8 Drawing Sheets

(51) Int. Cl.

| | |
|---|---|
| ***B22D 11/00*** | (2006.01) |
| ***B22D 11/041*** | (2006.01) |
| ***B22D 27/02*** | (2006.01) |
| ***B22D 11/103*** | (2006.01) |
| ***B22D 11/117*** | (2006.01) |
| ***B22D 21/00*** | (2006.01) |

(52) U.S. Cl.
CPC ..... *B22D11/117* (2013.01); *B22D 11/16* (2013.01); *B22D 21/005* (2013.01); *B22D 27/02* (2013.01); *B22D 27/04* (2013.01)

(56) References Cited

OTHER PUBLICATIONS

International Search Report; PCT/JP2014/051426; Mar. 11, 2014.
Written Opinion of the International Searching Authority; PCT/JP2014/051426; Mar. 11, 2014.

* cited by examiner

METHOD FOR CONTINUOUSLY CASTING INGOT MADE OF TITANIUM OR TITANIUM ALLOY

TECHNICAL FIELD

The invention relates to a method for continuously casting an ingot made of titanium or a titanium alloy, in which an ingot made of titanium or a titanium alloy is continuously cast.

BACKGROUND ART

Continuous casting of an ingot has been conventionally performed by pouring metal melted by vacuum arc melting and electron beam melting into a bottomless mold and drawing the molten metal downward while being solidified.

Patent Document 1 discloses an automatic control method for plasma melting casting, in which titanium or a titanium alloy is melted by plasma arc melting in an inert gas atmosphere and poured into a mold for solidification. Performing the plasma arc melting in an inert gas atmosphere, unlike the electron beam melting in vacuum, allows casting of not only pure titanium, but also a titanium alloy.

CITATION LIST

Patent Document

Patent Document 1: Japanese Patent No. 3077387

SUMMARY OF THE INVENTION

Technical Problems

However, if an ingot has irregularities and flaws on casting surface after casting, it is necessary to perform a pretreatment, such as cutting the surface, before rolling, thus causing a reduction in material utilization and an increase in number of operation processes. Therefore, it is demanded to cast an ingot without irregularities or flaws on casting surface.

In this method, when an ingot having a large size is continuously cast by the plasma arc melting, a plasma torch is configured to horizontally move on a predetermined course to heat the entire surface of molten metal. Further, by adjusting an output and a moving location, velocity, and ingot heat extraction of the plasma torch on the surface of the molten metal, it is intended to improve the quality of casting surface over the whole ingot.

However, it sometimes occurs that, by abrupt changes of operational conditions, such as a change in temperature fluctuation of the molten metal poured into a mold and a change in a contacting state between the molten metal and the mold, the balance of heat input and output is locally altered, thus the quality of casting surface is deteriorated.

Further, when temperature conditions are largely changed, the delay of the detection of such changes would cause operation troubles. For example, when the temperature is too low, it becomes difficult to draw an ingot because of its solidification, and when the temperature is too high, a solidified shell is broken, thereby causing the leakage of the molten metal.

The problem has been conventionally dealt by operators, who monitor the inner state of the mold and perform operations, such as manually changing a moving pattern of the plasma torch. However, there may be cases where detecting and measuring are delayed or overlooking occurs.

An object of the present invention is to provide a method for continuously casting an ingot made of titanium or a titanium alloy, capable of casing an ingot having an excellent casting-surface state.

Solution to Problems

The method for continuously casting an ingot made of titanium or a titanium alloy of the present invention is a method for continuously casting an ingot made of titanium or a titanium alloy by pouring molten metal prepared by melting titanium or a titanium alloy into a bottomless mold and drawing the molten metal downward while being solidified, the method being characterized in comprising: a heating step, where, while a plasma torch is horizontally moved on the surface of the molten metal in the mold, the surface of the molten metal is heated by plasma arcs generated by the plasma torch; a temperature-measuring step for measuring the temperature of the mold by each of temperature sensors provided in a plurality of positions of the mold along the circumferential direction of the mold; and a heat input quantity control step for controlling heat input quantity per unit area applied from the plasma torch to the surface of the molten metal based on the temperature of the mold measured by the temperature sensors and a target temperature preset in each of the temperature sensors.

In the above configuration, based on the temperature of the mold measured by the temperature sensors and the target temperature preset in each of the temperature sensors, the heat input quantity per unit area applied from the plasma torch to the surface of the molten metal is controlled. For example, the heat input quantity per unit area applied from the plasma torch to the surface of the molten metal is increased or decreased in such a manner that the temperature measured by the temperature sensors becomes the target temperature. By changing in real time the heat input quantity per unit area applied from the plasma torch to the surface of the molten metal based on the temperature measured by the temperature sensors and the target temperature, heat input/output conditions near the molten metal surface region can be appropriately controlled. Thus, it becomes possible to cast an ingot having an excellent casting-surface state.

Further, in the method for continuously casting an ingot made of titanium or a titanium alloy of the present invention, in the heat input quantity control step, if the temperature of the mold measured by any of the temperature sensors is lower than the target temperature, then output of the plasma torch may be increased when the plasma torch comes close to a location where such temperature sensor is installed, and if the temperature of the mold measured by any of the temperature sensors is higher than the target temperature, then the output of the plasma torch may be decreased when the plasma torch comes close to a location where such temperature sensor is installed. In the above configuration, by changing the output of the plasma torch in real time based on the temperature measured by the temperature sensors and the target temperature, the heat input/output conditions near the molten metal surface region can be appropriately controlled.

Further, in the method for continuously casting an ingot made of titanium or a titanium alloy of the present invention, the method may further comprise a calculation step for calculating a plasma torch output correction quantity based on the difference between the mold temperature measured by the temperature sensors and the target temperature, and then in the heat input quantity control step, correct the output of the plasma torch by adding the plasma torch output correction quantity to a standard plasma torch output pattern, which is a standard output pattern for the plasma torch. In the above configuration, the output of the plasma torch can be changed in real time based on the temperature measured by the temperature sensors and the target temperature.

Effect of the Invention

In the method for continuously casting an ingot made of titanium or a titanium alloy of the present invention, by changing in real time the heat input quantity per unit area applied from the plasma torch to the surface of the molten metal based on the temperature measured by the temperature sensors and the target temperature, the heat input/output conditions near the molten metal surface region can be appropriately controlled. Thus, it becomes possible to cast an ingot having an excellent casting-surface state.

DESCRIPTION OF EMBODIMENTS

Hereinafter, preferred embodiments of the present invention will be described with reference to the drawings.

Configuration of Continuous Casting Apparatus

Figure 1:
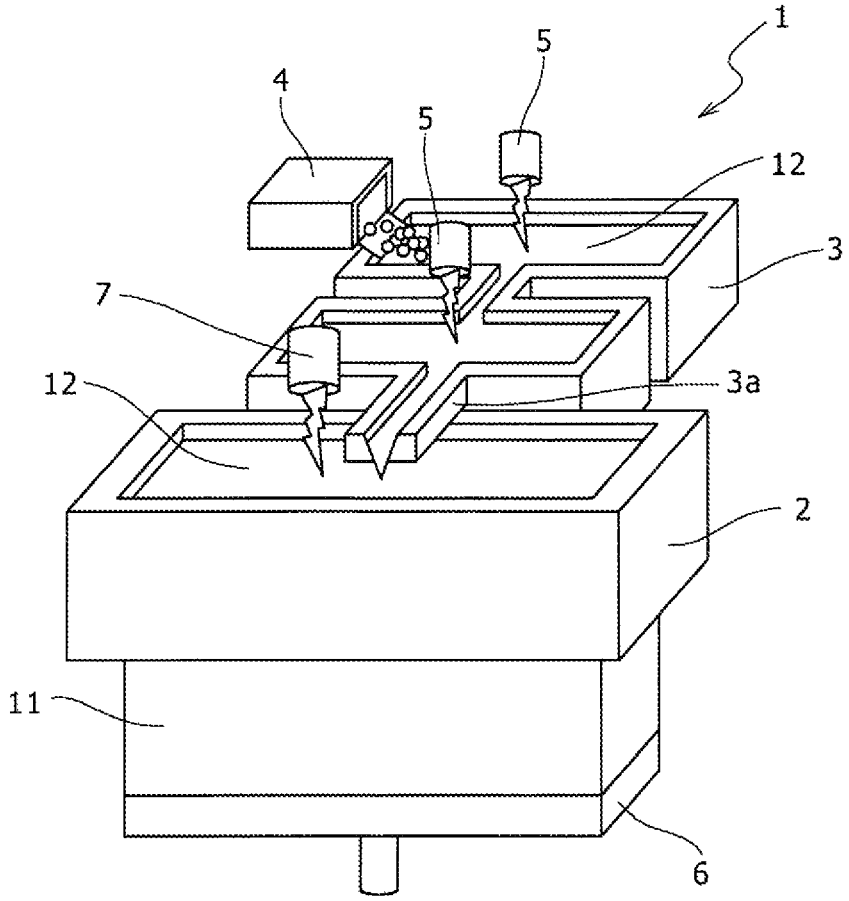
FIG. 1 is a perspective view of a continuous casting apparatus.
Figure 2:
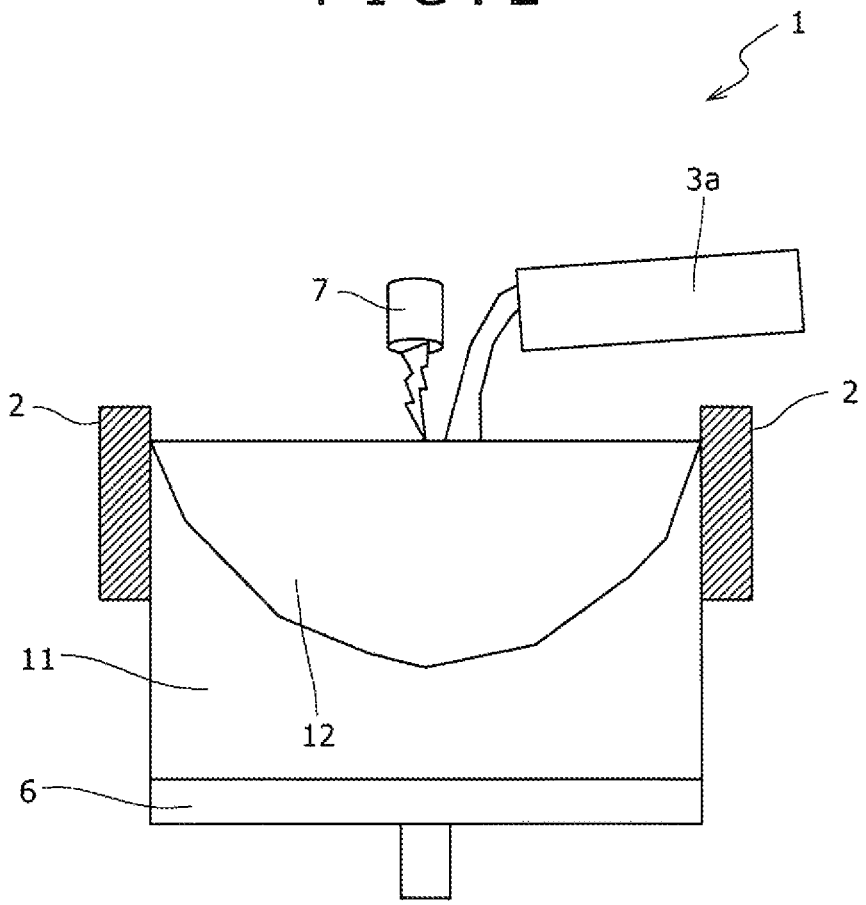
FIG. 2 is a cross-section view of the continuous casting apparatus.

In the method for continuously casting an ingot made of titanium or a titanium alloy of the present embodiments, by pouring molten metal of titanium or a titanium alloy melted by plasma arc melting into a bottomless mold and drawing the molten metal downward while being solidified, an ingot made of the titanium or the titanium alloy is continuously cast. A continuous casting apparatus 1 carrying out the method for continuously casting an ingot made of titanium or a titanium alloy, as shown in FIG. 1 depicting a perspective view thereof and FIG. 2 depicting a cross-section view thereof, includes a mold 2, a cold hearth 3, a raw material charging apparatus 4, plasma torches 5, a starting block 6, and a plasma torch 7. The continuous casting apparatus 1 is surrounded by an inert gas atmosphere comprising argon gas, helium gas, and the like.

The raw material charging device 4 supplies raw materials of titanium or a titanium alloy, such as sponge titanium, scrap and the like, into the cold hearth 3. The plasma torches 5 are disposed above the cold hearth 3 and used to melt the raw materials within the cold hearth 3 by generating plasma arcs. The cold hearth 3 pours molten metal 12 having the raw materials melted into the mold 2 through a pouring portion 3*a*. The mold 2 is made of copper and formed in a bottomless shape having a rectangular cross section. At least a part of a square cylindrical wall portion of the mold 2 is configured so as to circulate water through the wall portion, thereby cooling the mold 2. The starting block 6 is movable in the up and down direction by a drive portion not illustrated, and able to close a lower side opening of the mold 2. The plasma torch 7 is disposed above the molten metal 12 within the mold 2 and configured to horizontally move above the surface of the molten metal 12 by a moving means not illustrated, thereby heating the surface of the molten metal 12 poured into the mold 2 by the plasma arcs.

In the above configuration, solidification of the molten metal 12 poured into the mold 2 begins from a contact surface between the molten metal 12 and the mold 2 having a water-cooling system. Then, as the starting block 6 closing the lower side opening of the mold 2 is lowered at a predetermined speed, an ingot (slab) 11 in a square cylindrical shape formed by solidifying the molten metal 12 is continuously cast while being drawn downward from the mold 2.

In this configuration, it is difficult to cast a titanium alloy using the electron beam melting in a vacuum atmosphere since trace components in the titanium alloy would evaporate. In contrast, it is possible to cast not only pure titanium, but also the titanium alloy using the plasma arc melting in an inert gas atmosphere.

Further, the continuous casting apparatus 1 may include a flux loading device for applying flux in a solid phase or a liquid phase onto the surface of the molten metal 12 in the mold 2. In this configuration, it is difficult to apply the flux to the molten metal 12 in the mold 2 using the electron beam melting in a vacuum atmosphere since the flux would be scattered. In contrast, the plasma arc melting in an inert gas atmosphere has an advantage that the flux can be applied to the molten metal 12 in the mold 2.

Operational Conditions

When an ingot 11 made of titanium or a titanium alloy is produced by continuous casting, if there are irregularities or flaws on the surface (casting surface) of the ingot 11, they would cause surface detects in a rolling process, which is the next step. Thus such irregularities and flaws on the surface of the ingot 11 must be removed before rolling by cutting or the like. However, this step would decrease the material utilization and increase the number of operation processes, thereby increasing the cost of continuous casting. As such, it is demanded to perform the casting of the ingot 11 without irregularities or flaws on its surface.

Figure 3A:
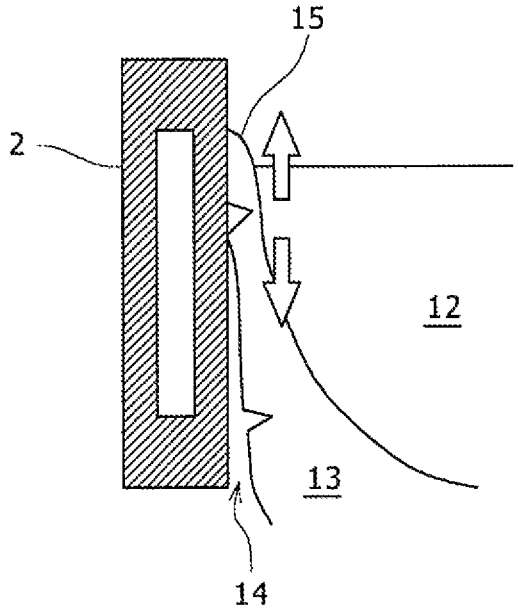
FIG. 3A is a drawing describing a causing mechanism of surface defects.
Figure 3B:
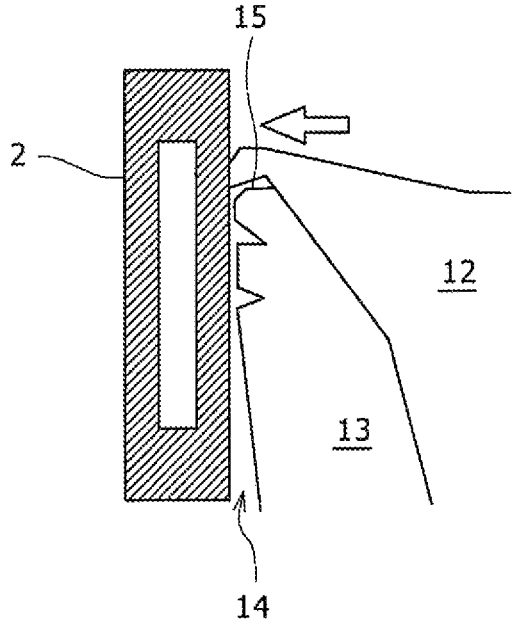
FIG. 3B is a drawing describing the causing mechanism of the surface defects.

As shown in FIGS. 3A and 3B, in continuous casting of the ingot 11 made of titanium, the surface of the ingot 11 (a solidified shell 13) contacts with the surface of the mold 2 only near a surface region of the molten metal 12 (a region extending from the molten metal surface to an approximately 10-20 mm depth), where the molten metal 12 is heated by the plasma arcs or the electron beam. In a region deeper than this contact region, the ingot 11 undergoes thermal shrinkage, thus an air gap 14 is generated between the ingot 11 and the mold 2. Then, as shown in FIG. 3A, if the heat input to an initial solidified portion 15 (a portion of the molten metal 12 initially brought into contact with the mold 2 to be solidified) is excessive, since the solidified shell 13 becomes too thin, there occurs a "tearing-off defect", in which the surface of the solidified shell 13 is torn off due to lack of strength. On the other hand, as shown in FIG. 3B, if the heat input into the initial solidified portion 15 is not sufficient, there occurs a "molten metal-covering defect", in which the solidified shell 13 that has been grown (thickened) is covered with the molten metal 12. Therefore, it is speculated that heat input/output conditions applied to the initial solidified portion 15 near the surface region of the molten metal 12 would have a great impact on properties of the casting surface, and it is considered that the ingot 11 having an excellent casting surface can be obtained by appropriately controlling the heat input/output conditions applied to the molten metal 12 near the molten metal surface region.

Figure 4:
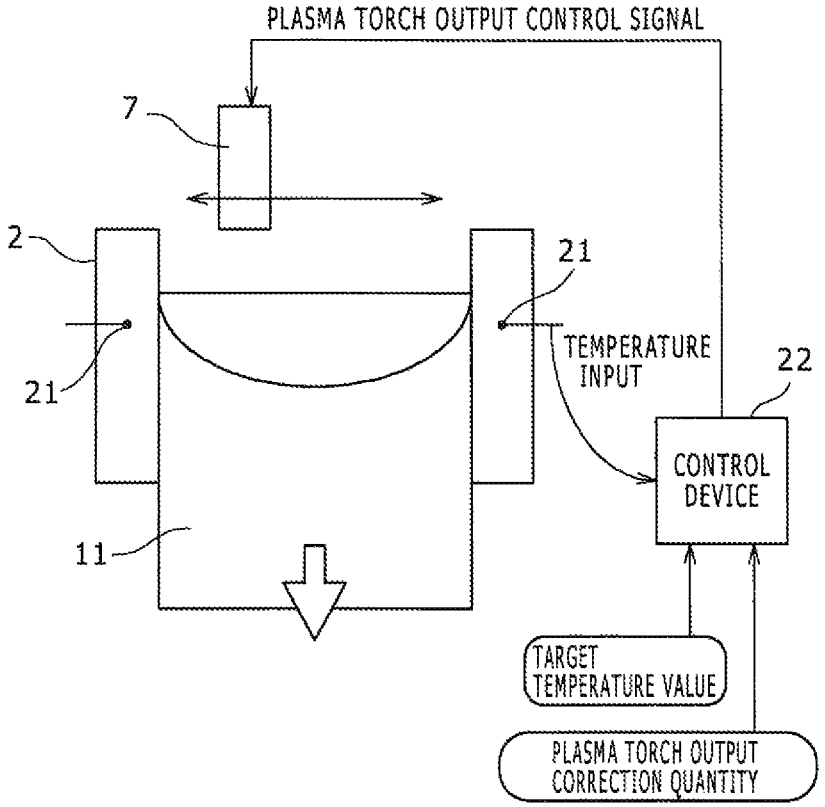
FIG. 4 is a model diagram of a mold, seen from side.
Figure 5:
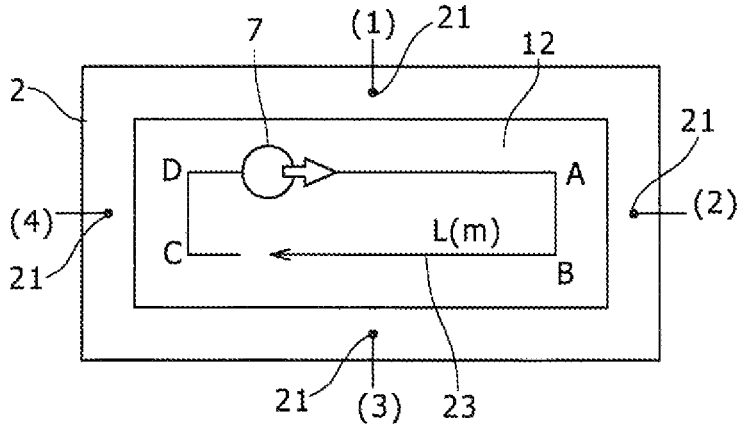
FIG. 5 is a model diagram of the mold, seen from above.

Hence, as shown in FIG. 4 depicting a model diagram of the mold 2 seen from the side and FIG. 5 depicting a model diagram of the mold 2 seen from the above, thermocouples (temperature sensors) 21 are provided in a plurality of positions of the mold 2 along the circumferential direction of the mold 2. Then, based on a temperature of the mold 2 measured by each of the thermocouples 21 and a target temperature preset in each of the thermocouples 21, it is configured to control heat input quantity per unit area applied from the plasma torch 7 to the surface of the molten metal 12. In the present embodiments, based on the temperature of the mold 2 measured by each of the thermocouples 21 and the target temperature preset in each of the thermocouples 21, it is configured to control output of the plasma torch 7 horizontally moving on the surface of the molten metal 12. Alternatively, the heat input quantity per unit area applied from the plasma torch 7 to the surface of the molten metal 12 may be controlled without changing the output of the plasma torch 7, for example, by changing the distance between the plasma torch 7 and the surface of the molten metal 12 or by changing a flow rate of a plasma gas. Further, a means for measuring the temperature of the mold 2 is not limited to the thermocouples 21, and optical fiber and the like may be used.

Specifically, the temperature of the mold 2 measured by each of the thermocouples 21 is inputted to a control device 22. In the control device 22, target temperature values preset in each of the thermocouples 21 and plasma torch output correction quantity are inputted. The control device 22, then, outputs a plasma torch output control signal based on the temperature of the mold 2 measured by each of the thermocouples 21 and the target temperature to the plasma torch 7. In this manner, if the temperature of the mold 2 measured by any of the thermocouples 21 is lower than the target temperature, the control device 22 controls the output of the plasma torch 7 so as to increase the output of the plasma torch 7 when the plasma torch 7 comes close to a location where such thermocouple 21 is installed. Further, if the temperature of the mold 2 measured by any of the thermocouples 21 is higher than the target temperature, the control device 22 controls the output of the plasma torch 7 so as to decrease the output of the plasma torch 7 when the plasma torch 7 comes close to a location where such thermocouple 21 is installed.

As described above, by changing in real time the heat input quantity per unit area applied from the plasma torch 7 to the surface of the molten metal 12 based on the temperature measured by the thermocouples 21 and the target temperature, the heat input/output conditions near the surface region of the molten metal 12 can be appropriately controlled. Thus, it becomes possible to cast an ingot 11 having an excellent casting-surface state.

Further, by changing the output of the plasma torch 7 in real time based on the temperature measured by the thermocouples 21 and the target temperature, the heat input/output conditions near the surface region of the molten metal 12 can be appropriately controlled.

In performing a control of the plasma torch 7, a standard plasma torch output pattern PA(L)[W], which is a standard output pattern of the plasma torch 7, capable of casting an ingot 11 having an excellent casting-surface state, is first determined in advance. Here, PA(L) represents an output value of the plasma torch 7 at a position L[m] on a moving route of the plasma torch 7. Further, a target temperature Ta(i)[° C.] of the mold 2 at each position i for measuring the temperature is determined in advance by operation results in the past, simulations, and the like. Specifically, when the casting is performed using the standard plasma torch output pattern PA(L), a measured temperature where the quality of the ingot surface is known to be excellent or a temperature where the quality of the ingot surface is predicted to be excellent is used as the target temperature Ta(i). The target temperature Ta(i) may be a measured value or a calculated value by simulations. Further, a plasma torch output correction quantity ΔP(L, ΔT(i))[W] is determined in advance based on the difference ΔT(i) between a measured temperature Tm(i)[° C.] by the thermocouples 21 and the target temperature Ta(i) of the mold 2. Here, ΔT(i) is given by $$\Delta T(i)=Tm(i)-Ta(i).$$

Then it is configured to measure the measured temperature Tm(i) of the mold 2 in real time during the casting. The plasma torch output P(L)[W] is then controlled according to the following formula 1.

$$P(L)=PA(L)+\Delta P(L,Tm(i)-Ta(i)) \quad \text{(Formula 1)}$$

Output adjustment described above is performed in every preset time interval.

More specifically, as shown in FIG. 5, torch positions A to D are designated at corner parts of a moving track 23 of the plasma torch 7. Further, the thermocouples 21 are each provided on the center parts of the long sides of the mold 2 and on the center parts of the short sides of the mold 2. The positions of the thermocouples 21 are hereinafter referred to as positions (1) to (4).

Figure 6A:
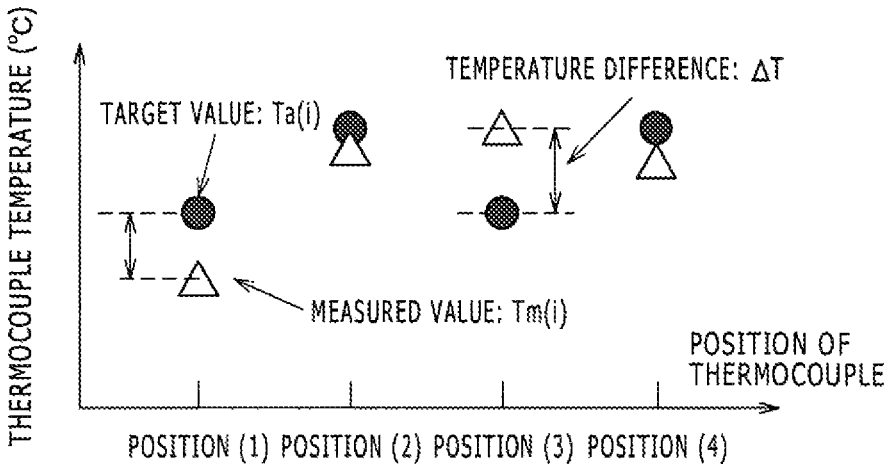
FIG. 6A is a graph showing measured temperatures and target temperatures to explain a calculation method for a plasma torch output after correction.
Figure 6B:
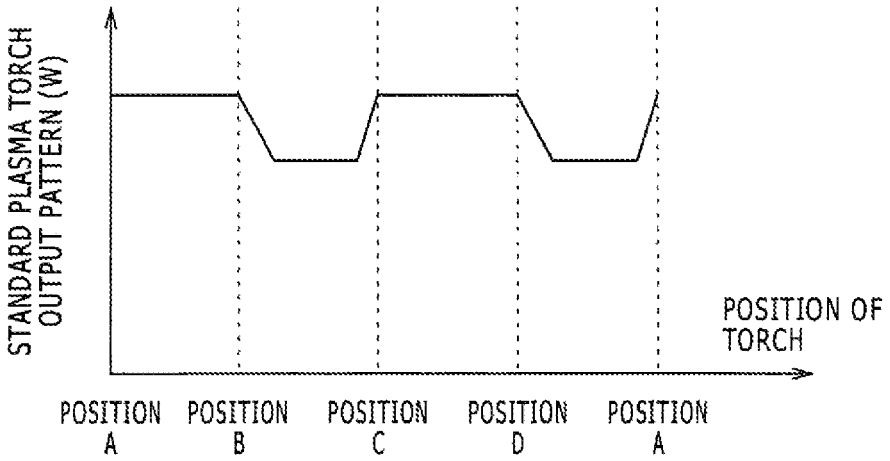
FIG. 6B is a graph showing a standard plasma torch output pattern to explain the calculation method for the plasma torch output after correction.

FIG. 6A shows the measured temperatures Tm(i) by the thermocouples 21 located on each of the positions (1) to (4) and the target temperatures Ta(i). Further FIG. 6B shows the standard plasma torch output pattern PA(L) at the torch positions A to D.

Figure 6C:
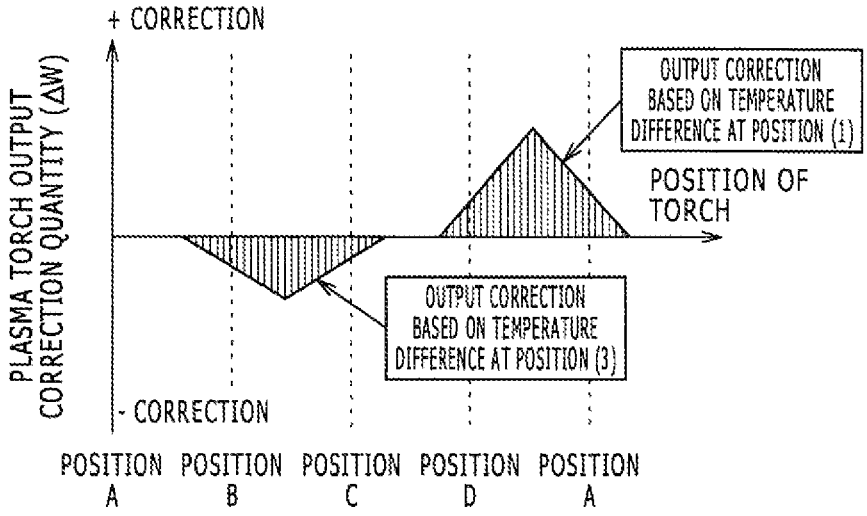
FIG. 6C is a graph showing a plasma torch output correction quantity to explain the calculation method for the plasma torch output after correction.
Figure 6D:
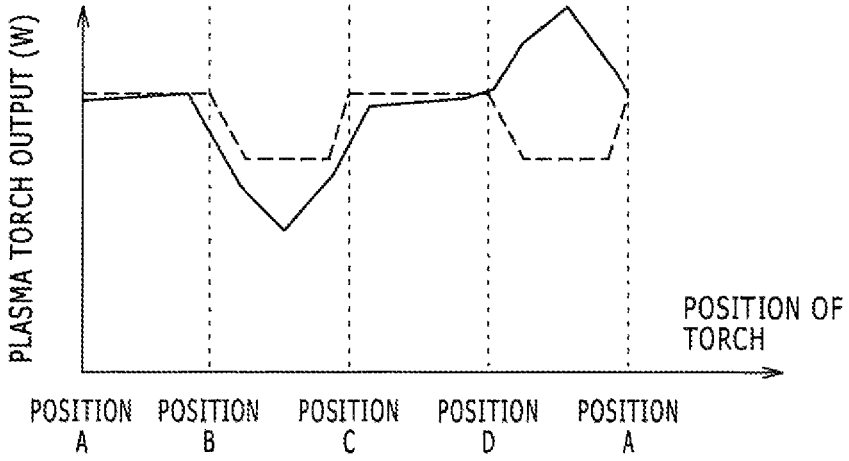
FIG. 6D is a graph showing a plasma torch output to explain the calculation method for the plasma torch output after correction.

In FIG. 6A, the plasma torch output correction quantity ΔP(L, ΔT(i)) can be obtained based on the difference ΔT(i) between the measured temperature Tm(i) and the target temperature Ta(i). FIG. 6C shows the plasma torch output correction quantity ΔP(L, ΔT(i)) at the torch positions A to D. The plasma torch output P(L) after correction is then obtained by adding the plasma torch output correction quantity ΔP(L, ΔT(i)) to the standard plasma torch output pattern PA(L). FIG. 6D shows the plasma torch output P(L) after correction at the torch positions A to D.

As shown above, the output of the plasma torch 7 is corrected by adding the plasma torch output correction quantity ΔP(L, ΔT(i)) to the standard plasma torch output pattern PA(L). By this correction, the output of the plasma torch 7 can be changed in real time based on the measured temperature by the thermocouples 21 and the target temperature.

The plasma torch output correction quantity ΔP(L, ΔT(i)) can be obtained by the following formula 2.

$$\Delta P(L,\Delta T(i))=\Sigma(i=1,N)(\Delta Pu(L,i)\times fd(Tm(i)-Ta(i))) \quad \text{(Formula 2)}$$

In this formula, N represents a measurement number of the temperature, ΔPu(L, i)[W/° C.] represents a plasma torch output correction value when the measured temperature by the thermocouple 21 at the i-th position is deviated from its target temperature by unit temperature, and fd(ΔT)[° C./° C.] represents a correction coefficient based on a deviated amount from the measured temperature value.

Figure 7A:
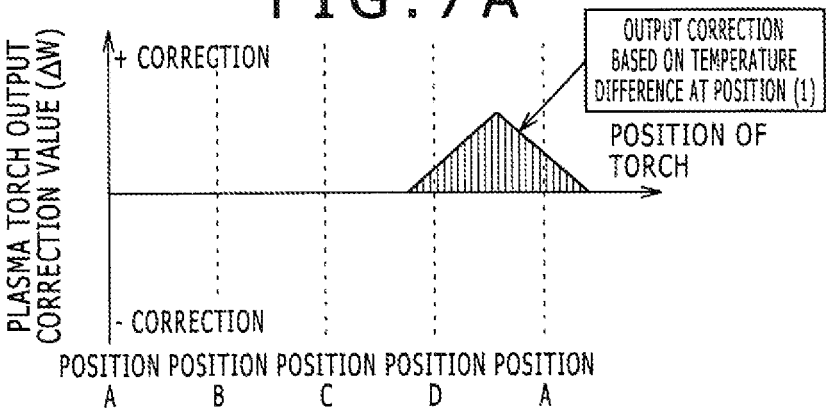
FIG. 7A is a graph showing a plasma torch output correction value to explain a calculation method for a plasma torch output correction quantity.
Figure 7B:
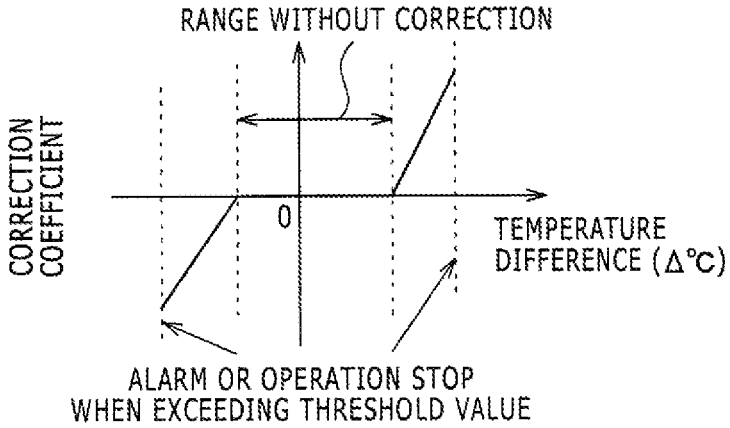
FIG. 7B is a graph showing a correction coefficient to explain the calculation method for the plasma torch output correction quantity.
Figure 7C:
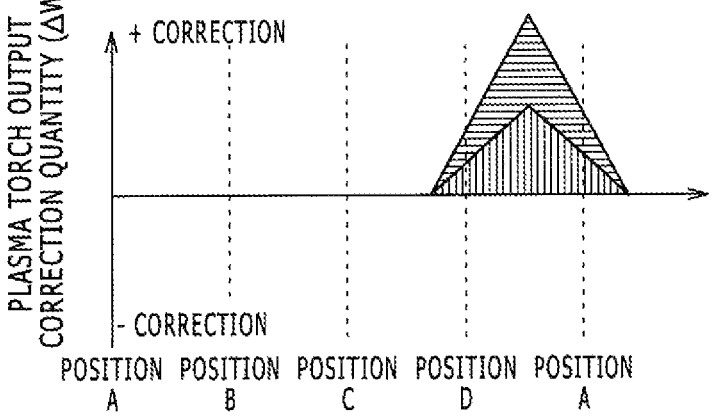
FIG. 7C is a graph showing a plasma torch output correction quantity to explain the calculation method for the plasma torch output correction quantity.

FIG. 7A shows the plasma torch output correction value ΔPu(L, i), and FIG. 7B shows the correction coefficient fd(ΔT). When the difference between the target temperature and the measured temperature becomes extremely large, operational troubles may occur due to abnormal solidification. Thus, when the difference between the target temperature and the measured temperature exceeds a predetermined threshold value, it may be configured to take actions such as outputting an alarm to an operator, reducing a drawing speed, and stopping the casting. FIG. 7C shows the plasma torch output correction quantity ΔP(L, ΔT(i)) calculated from the plasma torch output correction value ΔPu(L, i) and the correction coefficient fd(Tm(i)−Ta(i)).

Effects

As described hereinabove, in the method for continuously casting an ingot 11 made of titanium or a titanium alloy according to the present embodiments, based on the temperature of the mold 2 measured by the thermocouples 21 and the target temperature preset in each of the thermocouples 21, the heat input quantity per unit area applied from the plasma torch 7 to the surface of the molten metal 12 is controlled. For example, the heat input quantity per unit area applied from the plasma torch 7 to the surface of the molten metal 12 is increased or decreased in such a manner that the temperature measured by the thermocouples 21 becomes the target temperature. By changing in real time the heat input quantity per unit area applied from the plasma torch 7 to the surface of the molten metal 12 based on the temperature measured by the thermocouples 21 and the target temperature, the heat input/output conditions near the surface region of the molten metal 12 can be appropriately controlled. Thus, it becomes possible to cast an ingot 11 having an excellent casting-surface state.

Further, if the temperature of the mold 2 measured by any of the thermocouples 21 is lower than the target temperature, then the output of the plasma torch 7 is increased when the plasma torch 7 comes close to a location where such thermocouple 21 is installed. Further, if the temperature of the mold 2 measured by any of the thermocouples 21 is higher than the target temperature, then the output of the plasma torch 7 is decreased when the plasma torch 7 comes close to a location where such thermocouple 21 is installed.

In this manner, by changing the output of the plasma torch 7 in real time based on the temperature measured by the thermocouples 21, the heat input/output conditions near the surface region of the molten metal 12 can be appropriately controlled.

Further, by adding the plasma torch output correction quantity to the standard plasma torch output pattern, the output of the plasma torch 7 is corrected. In this manner, the output of the plasma torch 7 can be changed in real time based on the temperature measured by the thermocouples 21.

Modifications

Figure 8:
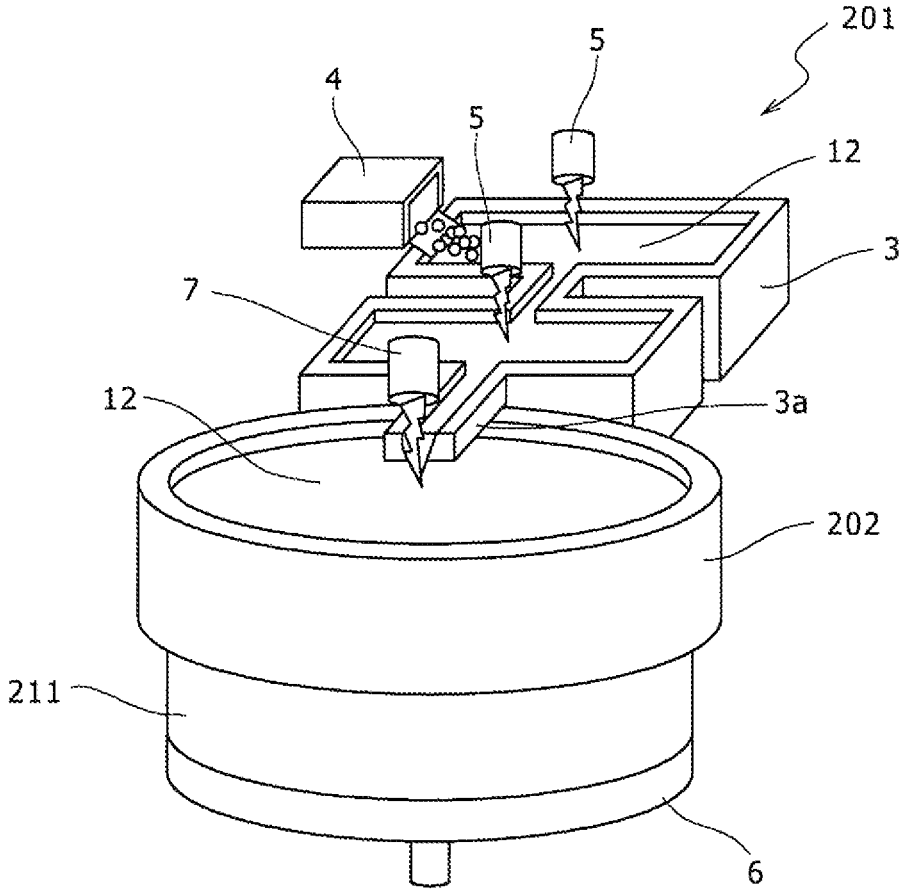
FIG. 8 is a perspective view of a continuous casting apparatus different from the one shown in FIG. 1.

It is noted that a continuous casting apparatus 201 carrying out the continuous casting method of the present embodiments, as shown in FIG. 8, may be configured so as to continuously cast an ingot 211 having a cylindrical shape using a mold 202 having a circular cross section.

Modifications of the Present Embodiments

The embodiments of the present invention are described hereinabove, however, it is obvious that the above embodiments solely serve as specific examples and are not to limit the present invention. The specific structures and the like of the present invention may be modified and designed according to the needs. Further, the actions and effects of the present invention described in the above embodiments are no more than most preferable actions and effects achieved by the present invention, thus the actions and effects of the present invention are not limited to those described in the above embodiments of the present invention.

The present application is based on Japanese Patent Application (Japanese Patent Application No. 2013-012034) filed on Jan. 25, 2013, the contents of which are incorporated herein by reference.

EXPLANATION OF REFERENCE NUMERALS

1, 201 Continuous casting apparatus
2, 202 Mold
3 Cold hearth
3*a* Pouring portion
4 Raw material charging apparatus
5 Plasma torch
6 Starting block
7 Plasma torch
11, 211 Ingot
12 Molten metal
13 Solidified shell
14 Air gap
15 Initial solidified portion
21 Thermocouples
22 Control device
23 Moving track

The invention claimed is:

1. A method for continuous casting an ingot made of titanium or a titanium alloy by pouring molten metal prepared by melting titanium or a titanium alloy into a bottomless mold and drawing the molten metal downward while being solidified, the method comprising:

a heating step, where, while a plasma torch is horizontally moved along a predetermined moving track above the surface of the molten metal in the mold, the surface of the molten metal is heated by plasma arcs generated by the plasma torch at a plurality of plasma torch positions along the predetermined moving track, wherein moving the plasma torch along the predetermined moving track sequentially positions the plasma torch in a plurality of predetermined plasma torch positions relative to the surface of the molten metal in the mold;

a temperature-measuring step for measuring a temperature of the mold by each of a plurality of temperature sensors provided in a plurality of temperature sensor positions of the mold along the circumferential direction of the mold; and a heat input quantity control step for controlling heat input quantity per unit area applied from the plasma torch to the surface of the molten metal based on the temperature of the mold measured by the temperature sensors and a target temperature preset in each of the temperature sensors, wherein the heat input quantity per unit area applied from the plasma torch to the surface of the molten metal near a specific temperature sensor position of the plurality of temperature sensor positions is controlled in a region along the predetermined moving track that corresponds to the specific temperature sensor position.

2. The method for continuous casting an ingot made of titanium or a titanium alloy according to claim 1, wherein:

if the temperature of the mold measured by any of the temperature sensors is lower than the target temperature, then output of the plasma torch is configured to increase when the plasma torch comes close to a location where such temperature sensor is installed; and if the temperature of the mold measured by any of the temperature sensors is higher than the target temperature, then the output of the plasma torch is configured to decrease when the plasma torch comes close to a location where such temperature sensor is installed.

3. The method for continuous casting an ingot made of titanium or a titanium alloy according to claim 2, wherein:

the method further comprises a calculation step for calculating a plasma torch output correction quantity based on the difference between the mold temperature measured by the temperature sensors and the target temperature; and in the heat input quantity control step, the output of the plasma torch is corrected by adding the plasma torch output correction quantity to a standard plasma torch output pattern, which is a standard output pattern for the plasma torch.

* * * * *